US006899634B2

(12) United States Patent
Hull et al.

(10) Patent No.: US 6,899,634 B2
(45) Date of Patent: May 31, 2005

(54) GOLF TRAINING AID KIT AND METHOD OF USE

(76) Inventors: Danny M. Hull, 7630 Tholl Dr., Reno, NV (US) 89506; Joseph F. Stout, 601 12th St., Sparks, NV (US) 89431

( * ) Notice: Subject to any disclaimer, the term of this patent is extended or adjusted under 35 U.S.C. 154(b) by 0 days.

(21) Appl. No.: 10/654,531

(22) Filed: Sep. 3, 2003

(65) Prior Publication Data

US 2005/0049062 A1 Mar. 3, 2005

(51) Int. Cl.[7] ..... A63B 69/36; A63B 65/00
(52) U.S. Cl. ..... 473/226; 473/235
(58) Field of Search ..... 473/219, 226, 473/235, 280, 573

(56) References Cited

U.S. PATENT DOCUMENTS 3,401,941 A * 9/1968 Hesidence ..... 473/235
3,721,447 A * 3/1973 Louderback ..... 473/235
3,870,316 A * 3/1975 DeBrocke ..... 473/235
4,029,316 A * 6/1977 Clarke ..... 473/573
4,244,576 A * 1/1981 Mosier et al. ..... 473/159
4,826,173 A * 5/1989 Brown ..... 473/235
D308,994 S * 7/1990 Norman et al. ..... D21/713
5,082,284 A * 1/1992 Reed ..... 473/235
5,702,309 A * 12/1997 Lee ..... 473/235
5,713,799 A * 2/1998 Balmat ..... 473/200

* cited by examiner

*Primary Examiner*—Gregory Vidovich
*Assistant Examiner*—Nini F. Legesse

(57) ABSTRACT

As taught herein, we provide a kit that includes novel components that are usable for training a person to play the game of golf. The kit provides a practice pad, a golf club head patch member and a unique three-dimensional hollow compression ball in combination. The ball automatically adheres onto the patch member when struck and upon impact deforms and retains deformed shape or memory until manually removed. The ball also includes a leg member that functions as a golf tee and a pointer thereon that visually informs and displays implied trajectory.

16 Claims, 3 Drawing Sheets

FIG. 10
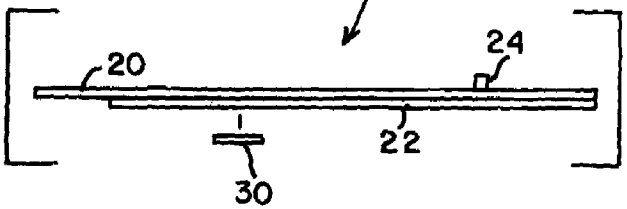
FIG. 9
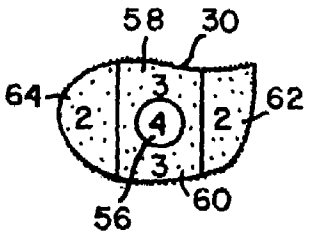
70
| | | | |
|---|---|---|---|
| 3 -1 = | 2 | 4 3 = | 7 |
| 4 2 = | 6 | 2 1 = | 3 |
| 3 3 = | 6 | 3 3 = | 6 |
| 3 3 = | 6 | 4 4 = | 8 |
| 4 -1 = | 3 | 1 3 = | 4 |
| 2 2 = | 4 | 2 2 = | 4 |
| 2 3 = | 5 | 4 2 = | 6 |
| 4 3 = | 7 | 3 1 = | 4 |
| 2 -1 = | 1 | 2 2 = | 4 |
| 40 | | 45 | |
FIG. 11

GOLF TRAINING AID KIT AND METHOD OF USE

FIELD OF THE INVENTION

This invention relates in general to sports training aids, but more particularly pertains to a kit used for enhancing a players skills pertaining to their golf game. The kit provides in combination, a practice pad, a golf club head patch member and a unique compression ball that retains memory upon impact and includes a pointer thereon. Thus, when the ball is hit with a golf club, the pointer will automatically visually inform the user if they hit the ball properly so as to achieve maximum results when playing the game. This is easily accomplished as the training ball automatically adheres to the golf club head member when hit therewith. Thus the user can visually determine the exact point of impact or more importantly the exact implied trajectory and this allows the user to evaluate their striking performance and then correct accordingly. We also teach a novel game and game rules for play.

BACKGROUND OF THE INVENTION

Sports in general have become extremely popular, due to which numerous attempts have been made to provide sports training aids which can be used to improve ones performance and accuracy. However, such training aids include complicated devices and/or costly equipment and therefore have not become popular. For example, practice clubs have been proposed which are used to practice one's swing, but are not used to hit balls. These practice clubs include golf clubs that are weighted much heavier than the normal golf club and are intended to build up the player's muscles. Such clubs are either weighted so the entire club is heavier than the normal club, or are weighted so they are heavier in the club head only. Also in this category, weights are applied to a normal club to make the head heavier than normal. Other clubs include various weights and weight distribution, and some of which are tied, tethered or attached to a stationary object to force the player to swing the practice club through a set pattern or path, presumed to be a correct swing for actual play. The distinguishing feature of these types of clubs is that they are not used to actually hit a ball. Even the standard club to which a weight is attached to the club head is not used to hit a ball while the excess weight is attached.

Other types of sports training aids include systems for golf practice. Wherein the user practices with his or her regular golf clubs hitting regular golf balls and further incorporate the use of nets, nets with targets, mats for teeing up the ball, various guides for position of the feet, for club path or for body position, impact decals, powders or detectors for showing where on the club head face the ball was hit, etc.

Still further examples include devices or systems wherein the user practices with his or her regular golf clubs and hits a regular sized but lighter in weight ball, such as a "WHIFFLE™" ball, or a foam or sponge ball having a weight embedded in the foam. Other examples include a ball that is connected to a lever that swivels about a pin, and remains attached to a mat or base when the player hits the ball with a standard golf club.

Some examples of the known prior art include U.S. Pat. Nos. 5,121,924, 5,702,309, 5,782, 4,826,173, 3,917,271, 3,889,950 and 5,082,284. However, each of these references are very limited as they include a sponge type ball having VELCRO™ material attached thereon, respectively. These references teach an interesting theory but in reality the systems simply do not work. The applicants have made numerous in depth experiments with these references and they are very inefficient and have not been successful in the marketplace due to many inherent disadvantages and drawbacks.

Namely, the most important disadvantage within the known prior art is the actual construction of the ball itself. As can be seen within each of these patents, due to the use of a sponge the result is simply a sponge ball having VELCRO™ strips thereon. Whereby, producing a ball that will not deform upon impact, it will not retain memory upon impact, it is not a compression ball, and most often simply does not stick to the contact surface, as it is much too dense and heavy. In fact, during actual use and experiments with these balls it has been determined that they only actually stick to the hitting surface about 70% of the time. This is very different than the present ball as due to its construction it consistently sticks about 97% of the time, which is very important and most advantageous.

Also, the applicants found that within the noted references the golf-tees as presented are very flimsy and upon normal impact tend to collapse or completely break. Another disadvantage is that these references do not include a ball that when struck actually makes a very distinct sound similar to hitting a typical golf ball, such as taught within the present invention. The actual sound produced by the present ball when struck is so realistic that those observing actually look to see where the ball will land, this is very important and unique to our ball construction.

Numerous other examples include, full body vests, harnesses, laser-guided devices, electronic detectors, and the like. All of which are much too costly, cumbersome, are difficult to use, simply ineffective, they are not easily transported, and they are not compact so as to be easily stored when not in use, etc.

As is well known within the field of sports, it is desirable to hit a sports related object "such as a ball" at the proper angle and most striking members "such as a golf club" include a head member having a pre-determined section typically known as the "sweet spot". Therefore, if a player can consistently properly align the "sweet spot" with the ball when striking, overall performance and accuracy is improved, and the likelihood for hitting a target is greatly increased.

Thus, the intended use and purpose of the present invention is to improve a users striking skills so as to increase the probability that they will strike the ball consistently in a manner which aligns the "sweet spot" in proper alignment with the ball so as to increase their odds of hitting a hole in one. This is easily achieved, as when the player strikes the ball, the ball automatically adheres (and substantially deforms and retains that shape due to compression at the point of impact) onto the head member at the exact point of contact and the user can visually determine the implied trajectory. For example, after the ball is struck the pointer thereon visually displays if the ball was hit exactly centrally on the "sweet spot", if it was spiraling in a certain direction, or if it was simply off center. Thereafter, with continuing practice they can adjust the stroke style accordingly until they consistently hit the ball properly.

Therefore the applicants contend there is a great need for a golf training aid that overcomes the inherent disadvantages and drawbacks associated with the known prior art. Thus we now herein provide a novel sports training aid which has not been heretofore taught as follows.

SUMMARY OF THE INVENTION

It is therefore an object of the present invention to provide a golf training aid kit which is very economical to produce and can easily be marketed.

Another object of the present invention is to provide a golf training aid kit that is extremely easy and very fun to use, is challenging and causes competitiveness when used by multiple players. Therefore, we also provide and teach a game and game rules which can be played with the present kit.

Yet another object of the present invention is to provide a golf training aid kit that greatly improves one's stroke or arm swing, especially when used repeatedly over time with practice.

Still another important object is to provide a golf training aid kit wherein some of the components can be used independently, or the different components can be used in combination, as will be described later herein.

Yet a further object of the present invention is to provide a golf training aid kit that can be sold as one complete kit including game rules, or the different components can be sold separately.

A very important object of the present invention is to provide a golf training aid kit which can be easily used either indoors or outdoors, it is very safe, it can be used on an irregular surface and it can be used even in an area having limited space.

Still a further object of the present invention is to provide a golf training aid kit which includes a special ball that is constructed in a unique novel manner heretofore not taught". For example, the ball is hollow and made only from interconnected VELCRO™ strips and a fastener in combination. It is to be noted the manner in which the VELCRO™ strips are interconnected is extremely important and this provides most unusual results not achieved within the prior art. For example, the unique characteristics of the present ball as constructed, provides an extremely light-weight ball having very little density, and due to this construction creates a three-dimensional compression ball that retains memory upon impact and remains in this compressed position until manually removed from the golf club head patch member. The ball when constructed in this manner also forms a leg member that is usable as a typical golf tee. This is very novel and functional. Still further and very important, when the ball is hit by a striking member, it produces a sound extremely similar to the noise made when a golf club hits a typical golf ball, this is caused from compression and air being expelled from the ball when struck, respectively. This is achieved due to finely configured air circulation holes formed in the VELCRO™ strips. It is to be noted the present ball configuration is also extremely attractive and aesthetically pleasing to the eye.

Still a further object of the present invention is to provide a golf training aid kit wherein the above described ball can be easily manufactured and produced from one single cut, thereafter the integrally formed VELCRO™ strips are folded in a certain pattern so as to form the desired shape and then secured and interconnected by suitable fastener means of engineering choice. The fastener not only serves to interconnect the strips but further functions as a suitable and very efficient pointer means for visually displaying implied trajectory.

Yet another object of the present invention is to provide a golf training aid kit which includes a unique ball support structure and practice pad in combination, which allows the ball to be easily disengaged there from when struck yet will not interfere with the direction of implied trajectory. Also the practice pad is unique as it is formed from two interconnecting members. This provides most unusual results not heretofore taught as this configuration eliminates friction as well as stress and this allows the top member to lift forward and upward and not tear. Again, the inventors have experimented and found that normal tee's and practice pads tend to tear easily and the golf tees constantly break. The present invention totally eliminates these problems in a new manner.

A further object of the present invention is to provide a golf training aid kit which includes a unique golf club head patch member which is of a shape and size to be removably attached onto the head member of the golf club and which is universal in size so as to be completely adjustable and be attachable to substantially any type of golf club of user choice. It is to be understood that such a patch member will not mar or damage the golf club in any manner, which is extremely important. Also, the present inventors have discovered that the patch member should not be limited for use on only the hitting surface of the golf club head but it should also cover the top and bottom sections, or the entire golf club head itself. Thus we further provide a variety of patch members and/or a patch member that is in the form of an adjustable sock, respectively. This is very important as it has been found that beginners or the like tend to strike poorly and many times the ball will actually stick to the top, bottom or even the backside of the club head patch member. This also eliminates the need for the user to chase after the ball as due to the patch members construction and overall coverage, the ball "seldom to never" will not stick. This is unique to this invention as within all of the known prior art, the ball only adheres 70% of the time while the current ball adheres 97% of the time and this is a great improvement.

Yet another object of the present invention is to provide a golf training aid kit wherein the above noted practice pad includes attachment means for removably attaching at least one of the golf club head patch members thereon for storage and aesthetic purposes. Thus, when not in use, the practice pad, ball, and patch members can each be rolled up together in a compact manner.

Still another object of the present invention is to provide within the golf training aid kit rules and regulations for playing a novel exciting game, heretofore not taught.

Other objects and advantages will be seen when taken into consideration with the following drawings and specification.

BRIEF DESCRIPTION OF THE DRAWINGS

FIG. 9 is substantially an overview of a golf club head patch member of FIG. 5 but further includes indicia thereon pertaining to play of a novel game.

FIG. 10 is substantially a plan view for attaching one of the golf club head patch members onto the underside of the practice pad.

FIG. 11 is substantially an overview for exemplifying a score card.

DETAILED DESCRIPTION OF THE DRAWINGS

Figure 1:
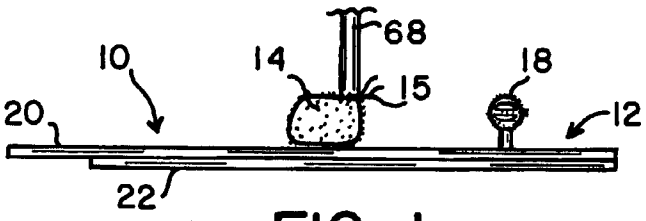
FIG. 1 is substantially an overview depicting each of the components in combination which form the kit.

Referring now in detail to the drawings wherein like characters refer to like elements throughout the various views. The present invention is substantially a golf training aid kit and includes numerous components in combination, each of which are described as follows: The kit (10) of the present invention includes a practice pad (12), a first alternative golf club head patch member (14) which is removably attached onto a golf club head (16) and a three-dimensional hollow compression ball (18). It is to be understood that due to the novel construction of the compression ball (18) (later described) it automatically adheres onto the golf club head patch member (14) when struck therewith and upon impact the ball deforms and retains the deformed shape or memory until manually removed from the patch member.

Figure 4:
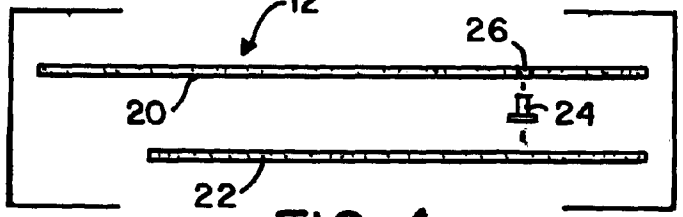
FIG. 4 is substantially a plan view for constructing the practice pad and a ball support structure in combination.
Figure 7:
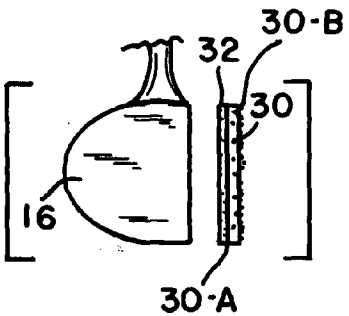
FIG. 7 is substantially a plan view for attaching the first golf club head patch member onto the striking surface of a golf club head.
Figure 6:
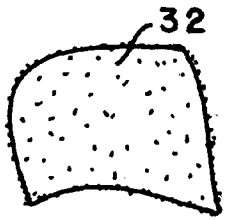
FIG. 6 is substantially an overview of the preferred embodiment for a second golf club head patch member.

Referring now to the practice pad (12) as depicted in FIGS. 1, 4, & 10. Wherein, the pad (12) substantially comprises a top element (20), a bottom element (22) and a ball support structure (24). Top element (20) having a first end, a second end and a central section respectively, and bottom element (22) having a first end, a second end, and a central section respectively. The central section of top element (20) is fixedly attached onto both the first end and the central section of bottom element (22), respectively. The first end of top element (20) and the first end of bottom element (22) being spaced apart and not in alignment with each other, while the second end of top element (20) and the second end of bottom element (22) are in alignment with each other respectively, but not attached together and the top element (20) having attachment means for removably attaching the ball support structure (24) thereon.

It is to be understood the above noted attachment means for attaching the central section of top element (20) onto both the first end and the central section of bottom element (22) is to be any suitable attachment means of engineering choice. Such as glue, adhesive, tape, staples, pins, etc. This is also true for the last noted attachment means, namely the attachment means for removably attaching the ball support structure (24) onto the practice pad. Thus the following is only exemplary of one possible attachment means and the invention is not to be limited thereto.

As depicted in FIG. 4, it can clearly be seen that the above noted attachment means for removably attaching the ball support structure (24) thereon includes top element (20) having an opening (26) located substantially between the central section of top element (20) and the second end of top element (20). The ball support structure (24) as taught herein is in the form of a rubberized disc, respectively, having a centralized integrally formed upraised hollow protrusion. With the rubberized disc being positioned between the top element (20) and the bottom element (22) and aligned with opening (26) and the integrally formed upraised hollow protrusion extends upwardly from within opening (26) in a manner which allows the upraised hollow protrusion to function as a receptacle, and/or more specifically a golf tee for receiving and supporting the leg member (28) of ball (18) therein.

It is to be understood this type of embodiment is very functional and provides unusual results heretofore not taught. For example, when the leg member (28) of ball (18) is positioned within upraised hollow protrusion and it is then struck with a golf club head (16), the first end of top element (20) is simultaneously urged upward and forward while the second ends tend to remain in place, which in turn reduces stress and friction that is typically associated with normal practice pads having only one layer. This is very important as in use the applicants found that this not only improves performance but also extends the life of the practice pad and tremendously improves durability. Thus, the applicants discovered that normal practice pads made from one layer of material continuously tear and the golf tees constantly break. Whereas, due to the novel construction of the present practice pad and ball support structure tearing and breaking have been virtually eliminated. In fact the applicants have not broken one ball support structure as of yet. However, another advantage of this embodiment is that if the ball support structure (24) does break, the user simply manually pulls the broken structure from within opening (26) and inserts a new one. This is very easily accomplished as the structure (24) is simply positioned in place and is not fixedly attached in any manner.

As an additional optional feature of the present invention, element (22) may further include upon it's underside thereof, attachment means for removably attaching at least one of the golf club head patch members (14, 30, 32, or 34) thereon for convenient storage thereof, such as depicted in FIG. 11. This is very important as this allows a user to easily remove the desired patch member of their choice and then after use it can then be reattached and stored in an inconspicuous compact manner until needed for future use. This is further advantageous as this allows the kit to be easily folded when not in use as the patch members will not interfere when stored thereon. It is to be noted the last noted attachment means for removably attaching at least one of the golf club head patch members onto practice pad is of any suitable attachment means of engineering choice, thus the following description is only exemplary of one suitable type of attachment means.

The above noted attachment means for removably attaching at least one of the golf club head patch members thereon includes each of the golf club head patch members (30, 32, or 34) being formed from loop and pile fastener material such as VELCRO™ having a first side and a second side, and the second side being removably attachable onto the underside of bottom element (22) by the loop and pile fastener material. It is to be noted that as yet another option the underside of bottom element (22) may further include multiple recessed indents (not shown) that are of a shape and size to mate and receive each of the patch members therein. This is further advantageous as this allows the patch members when in a stored position to be retained in a flush non-obstructive manner. It is to be understood other suitable attachment means for attaching the patch member onto the practice pad include adhesive, glue, tape, etc.

Figure 5:
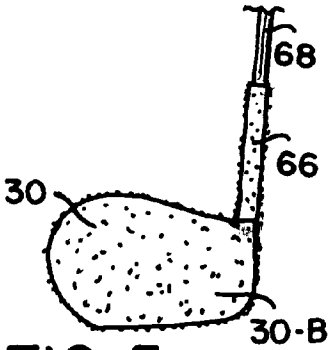
FIG. 5 is substantially an overview of the preferred embodiment for a first golf club head patch member.
Figure 8:
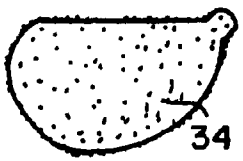
FIG. 8 is substantially an overview of the preferred embodiment for a third golf club head patch member.

Referring now to the construction of a first golf club head patch member (30) which is formed from a loop and pile fastener material such as VELCRO™ having a first side (30-A) and a second side (30-B) with the loop and pile fastener material being cut so as to be of a shape and size to mate with the striking surface of golf club head (16) respectively and the first side includes a removably attached adhesive strip (32). Whereby, when the removably attached adhesive strip (32) is removed, adhesive residue remains on the first side and the first side of loop and pile fastener material when positioned on the striking surface of golf club head (16) is held in a secure removably attached manner onto the striking surface of the golf club head by adhesive residue. As an option, golf club head patch member (30) may further include an upraised extension member (66) that is removably attachable onto a portion of a golf club handle (68) of the golf club such as depicted in FIG. 5.

In practice the applicants have discovered that it is very important to provide the kit with accessory golf club head patch members (14, 32 & 34) as beginners tend to hit the ball with not only the striking surface of the golf club head but also the top, bottom and even the backside of the club head. Thus, we herewith include a first accessory golf club head patch member which is formed from loop and pile fastener material having a first side and a second side. With the loop and pile fastener material being cut so as to be of a shape and size to mate with the topside of the golf club head (16) respectively, and the first side having a removably attached adhesive strip, such as (30). Whereby, when the removably attached adhesive strip (30) is removed, adhesive residue remains on the first side, and the first side of the loop and pile fastener material when positioned on the topside of the golf club head (16) is held in a secure removably attached manner onto the topside of golf club head (16) by the adhesive residue.

As noted above we further provide another accessory golf club head patch member (34) that is formed from loop and pile fastener material having a first side and a second side. With the loop and pile fastener material being cut so as to be of a shape and size to mate with the bottom side of the golf club head (16) respectively, and the first side having a removably attached adhesive strip, such as (30). Whereby, when the removably attached adhesive strip (30) is removed, adhesive residue remains on the first side, and the first side of the loop and pile fastener material when positioned on the bottom side of the golf club head (16) is held in a secure removably attached manner onto the bottom side of golf club head (16) by the adhesive residue.

The noted alternative golf club head patch member (14) is in the form of an adjustable sock (14) that completely encloses the entire golf club head therein, respectively, as depicted in FIG. 1. Wherein again the patch member or sock (14) is made solely from loop and pile fastener material and includes any suitable adjustment means of engineering choice so as to be functional and adjustable for use with different types of golf club heads. Some suitable fasteners include, snaps, buttons, VELCRO™, SILICONE™, a zipper, etc, or as depicted herein an elasticized drawstring (15) is most efficient.

Figure 2:
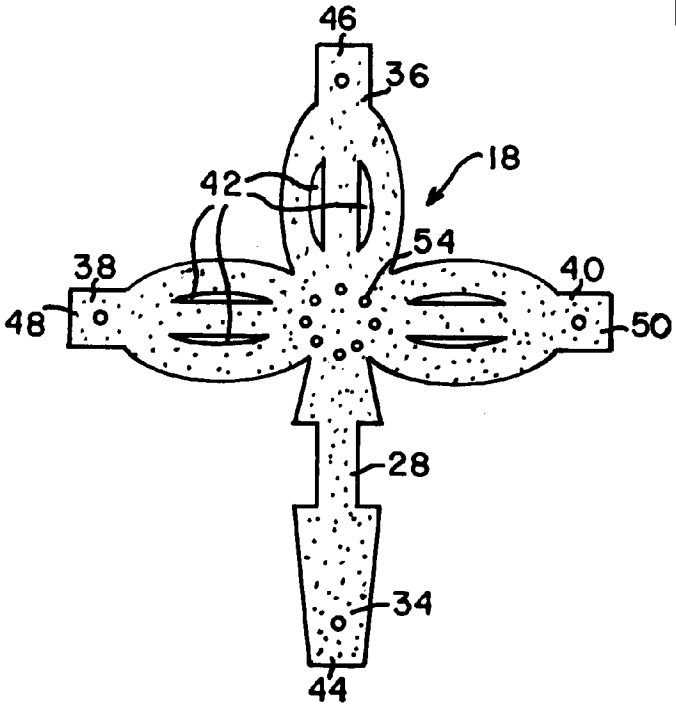
FIG. 2 is substantially an overview looking down upon the preferred pattern for cutting and constructing the compression ball before it is folded and interconnected.

Referring now to the actual construction of the three-dimensional hollow compression ball (18), which is of simple construction but provides novel unusual results. It is to be noted the method for manufacture of the ball includes use of a typical dye and cut pattern, such as illustrated in FIG. 2 and this allows the ball to be manufactured by one, single cut which is most advantageous. The ball is formed from a piece of loop and pile material which when cut using the noted dye, substantially forms a first extension member (34), a second extension member (36), a third extension member (38) and a fourth extension member (40). As can be seen in FIG. 2, each extension member (34, 36, 38 & 40) are integrally interconnected at a central point, respectively, with the first extension member (34) being opposed to second extension member (36) and third extension member (38) being opposed to fourth extension member (40). As can further be seen, second extension member (36), third extension member (38) and fourth extension member (40) each include multiple air circulation holes (42) there through. Furthermore, first extension member (34) provides a first exterior end (44), second extension member (36) provides a second exterior end (46), third extension member provides a third exterior end (48) and fourth extension member (40) provides a fourth exterior end (50). Also, each exterior end (44, 46, 48 & 50) have a hole (not numbered but clearly shown) there through. It is to be understood each exterior end is to be folded one on top of the other which allows each hole to be aligned together and each hole when aligned together in combination are of a shape and size to receive a fastener there through. It is to be noted the applicants through experimentation found that each of the exterior ends may be folded in a variety of ways but when positioned in the following manner as described proves to be most efficient and functional. Whereby, fourth exterior end (50) is folded over and positioned on top of third exterior end (48), second exterior end (46) is folded over and positioned on top of third exterior end (48) and first exterior end (44) is folded over and positioned on top of second exterior end (46).

Figure 3:
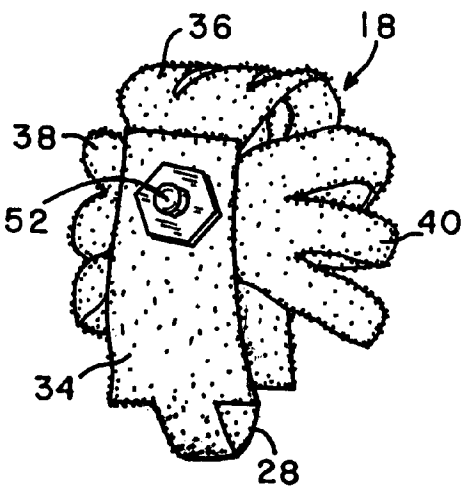
FIG. 3 is substantially an enlarged overview of the ball when folded, constructed and interconnected.

As can further be seen in FIGS. 2 and 3 second extension member (36), third extension member (38) and fourth extension member (40) in combination form a three-sided hollow spherical shape, respectively. Also, first extension member forms leg member (28) which functions as a golf tee, and the fastener (52) functions as a pointer. It is to be noted any suitable type of fastener of engineering choice may be incorporated, such as a nut and bolt, nut and washer, a tie clip, etc. However, whichever type of fastener that is used it should be eye-catching so as to clearly visually inform and display the implied trajectory to the user. As an option the fastener (52) may be fluorescent or simply very bright in color so as to enhance visibility. As another option the entire ball (18) and fastener (52) may be fluorescent so as to glow in the dark which provides novel fun and unusual results. It is to be further understood that the ball (18) when constructed in the manner as taught does not need any other support means such as a foam ball which is taught within the prior art as the VELCRO™ extensions (34, 36, 38 & 40) provide proper resiliency and in combination retain the desired shape. It is to be understood that this type of configuration is very strong and also provides the previously noted sound that is very novel. It is to be noted that the lighter the ball is the better it functions. Thus, if so desired the ball may further include additional perforated air circulation holes (54).

The ball (18) provides unusual results because when struck by the golf club head (16), the ball automatically adheres to the "sweet spot" thereon and being that the ball substantially collapses upon impact, the ball retains the memory of impact and thus suggests to the user the implied trajectory, and the ball retains this shape until manually removed from the "sweet spot".

For example, if the ball is struck properly, the ball will adhere onto the "sweet spot" in a somewhat flattened yet uniform position, respectively. However, if the ball is stuck improperly, this causes twisting of the ball and produces a spiraling force in the direction of twist. Whereby, the ball will adhere onto the "sweet spot" in a somewhat flattened position but not uniform and will look as though it is twisted. Therefore, the user can easily visually determine if they hit the ball in a forward trajectory, which is desirable, or if they hit the ball in a manner that would cause the ball to drift in a direction other than toward the target. It is to be understood that these unusual results are achieved because the ball is substantially pivotable, in multiple directions and this allows for twist and rotational force.

Also, it may be a novel feature to include some type of noisemaker, and/or even a light mechanism incorporated into the ball (18), so as to make noise and/or illuminate when the ball is forcibly struck.

Referring now to FIGS. 5 and 9, wherein golf club head patch member (30) is formed from loop and pile fastener material having a first side and a second side. The second side includes indicia thereon for defining different sections thereof, with the different sections each representing a different numerical value that allows for calculating a winning score after play of a novel game, (later described). For example, the different sections include a first central section (56) having a numerical value of four, a second section (58) located above first central section having a numerical value of three, a third section (60) located below first central section having a numerical value of three, a fourth section (62) located to the right of central section having a numerical value of two, and a fifth section (64) located to the left of central section having a numerical value of two. As noted above we further provide the following method for a first player to play a novel game using a golf training aid kit which includes in combination a practice pad (12) having a ball support structure (24) thereon, a golf club head patch member (30) which is removably attached onto a golf club head (16) of a golf club, a three-dimensional hollow compression ball (18), and a score card (70). As noted above, the golf club head patch member (30) includes indicia thereon for defining different sections thereof, and the different sections each representing a different numerical value that allows for calculating a winning score after play of said novel game, with the method for playing this novel game comprising the steps of:

a. positioning a practice pad (12) onto a support surface; positioning a three-dimensional hollow compression ball (18) onto a ball support structure (24);
   a. aligning the golf club and golf club head (16) with the three-dimensional hollow compression ball (18) in the usual manner;
   b. initiating and completing a normal golf swing, whereby when the three-dimensional hollow compression ball (18) is struck with the golf club head patch member (30), the three-dimensional hollow compression ball (18) automatically adheres onto the golf club head patch member (30);
   c. determining by visual inspection which section the three-dimensional hollow compression ball (18) has adhered onto;
   d. determining a numerical value indicated by the indicia on the section that the three-dimensional hollow compression ball (18) has adhered onto;
   e. entering the numerical value onto the score card (70);
   f. repeating steps "b" thru "g" again which completes one round;
   g. repeating steps "b" thru "g" until nine rounds or eighteen swings have been completed; and;
   h. calculating an overall final score which is then entered onto the score card (70).
   a. repeating steps "b" thru "h" by the first player so as to finish a first round;
   b. repeating steps "b" thru "h" by the second player so as to finish a first round;
   c. repeating steps "b" thru "h" until each player has completed nine rounds or eighteen swings;
   d. calculating an overall final score for each player which is then entered onto score card (70); and;
   e. determining a winner by calculating which player has the highest final score.

It is to be understood many variations of the game are inherent, thus we herewith provide some alternative rules of play. For example, a game can consist of only 9 swings or a variant thereof rather than 18 swings. There can be an unlimited amount of players. Also, there can be a jackpot for $1^{st}$, $2^{nd}$, and/or $3^{rd}$ place. Whereby, each player would pay a specified entry fee. Other rules may include if you fail to stick the ball upon a first try there is no penalty and the player gets another turn. Or perhaps the game may not begin until the player sticks the ball at least once. Thereafter, if the player fails to stick the ball it counts as −1, and if the player misses the ball twice it counts as −2. If a player scores all 3's it is considered a "par". Or if the player hits two 4's in a row it counts as 10. These are just a few examples of some of the alternative rules and thus variants thereof are to be considered inherent within the present overall invention.

It will now be seen we have herein provided a unique and novel golf training aid kit which is fun to play, improves one's performance, is cost effective to produce and sell, is of very simple construction, and overcomes the inherent disadvantages and drawbacks associated within the known prior art.

Although the invention has been herein shown and described in what is conceived to be the most practical and preferred embodiment, it is recognized that departures may be made there from within the scope and spirit of the invention, which is not to be limited to the details disclosed herein but is to be accorded the full scope of the claims so as to embrace any and all equivalent devices and apparatuses.

Having described our invention, what we claim as new and desire to secure by Letters Patent is:

1. A golf training aid kit comprising: in combination a practice pad; a golf club head patch member which is removably attached onto a golf club head; and a three-dimensional hollow compression ball; said three-dimensional hollow compression ball automatically adheres onto said golf club head patch member when struck therewith and upon impact said three-dimensional hollow compression ball deforms and retains deformed shape or memory until manually removed from said golf club head patch member, said three-dimensional hollow compression ball having a leg member which functions as a golf ball tee, said three-dimensional hollow compression ball being formed only from interconnected loop and pile strips with a fastener in combination, and said fastener functions as a pointer which visually informs and displays implied trajectory.

2. The golf training aid kit of claim 1 wherein said practice pad comprising: a top element; a bottom element; and a ball support structure; said top element having a first end, a second end, and a central section, said bottom element having a first end, a second end, and a central section, said central section of said top element being fixedly attached onto said first end and said central section of said bottom element, said first end of said top element and said first end of said bottom element being spaced apart and not in alignment with each other, said second end of said top element and said second end of said bottom element being in alignment with each other but not attached together, and said top element having attachment means for removably attaching said ball support structure thereon.

3. The golf training aid kit of claim 2 wherein said top element having attachment means for removably attaching said ball support structure thereon comprising: said top element having an opening located between said central section of said top element and said second end of said top element, said ball support structure being in the form of a rubberized disc having a centralized integrally formed upraised hollow protrusion, said rubberized disc being positioned between said top element and said bottom element and aligned with said opening, said integrally formed upraised hollow protrusion extending upwardly from within said opening, and said upraised hollow protrusion functions as a receptacle for receiving and supporting said leg member therein.

4. The golf training aid kit of claim 2 wherein said bottom element further includes an underside, and said underside having attachment means for removably attaching at least one said golf club head patch member thereon for convenient storage thereof.

5. The golf training aid kit of claim 4 wherein said underside of said bottom element having attachment means for removably attaching at least one said golf club head patch member thereon, said attachment means comprising: said golf club head patch member being formed from loop and pile fastener material having a first side and a second side, and said second side being removably attachable onto said underside of said bottom element by said loop and pile fastener material.

6. The golf training aid kit of claim 1 wherein said golf club head patch member is formed from loop and pile fastener material having a first side and a second side, said loop and pile fastener material being cut so as to be of a shape and size to mate with the striking surface of said golf club head and said first side having a removably attached adhesive strip, whereby:

when said removably attached adhesive strip is removed, adhesive residue remains on said first side, and said first side of said loop and pile fastener material when positioned on said striking surface of said golf club head is held in a secure removably attached manner onto said striking surface of said golf club head by said adhesive residue.

7. The golf training aid kit of claim 6 wherein said golf club head patch member is formed from loop and pile fastener material having a first side and a second side, said second side includes indicia thereon for defining different sections thereof, and said different sections each representing a different numerical value that allows for calculating a winning score after play of a novel game.

8. The golf training aid kit of claim 7 wherein said different sections each representing a different numerical value comprising: a first central section having a numerical value of four; a second section located above said first central section having a numerical value of three; a third section located below said first central section having a numerical value of three; a fourth section located to the right of said central section having a numerical value of two; and a fifth section located to the left of said central section having a numerical value of two.

9. The golf training aid kit of claim 6 further includes an upraised extension member that is removably attachable onto a portion of a golf club handle of said golf club.

10. The golf training aid kit of claim 1 wherein said three-dimensional hollow compression ball being formed only from interconnected loop and pile strips with a fastener in combination comprising: a piece of loop and pile material which when cut forms a first extension member; a second extension member; a third extension member and a fourth extension member; each said extension member being integrally interconnected at a central point, said first extension member being opposed to said second extension member, said third extension member being opposed to said fourth extension member, said second extension member, said third extension member, and said fourth extension member each having multiple air circulation holes there through, said first extension member providing a first exterior end, said second extension member providing a second exterior end, said third extension member providing a third exterior end, said fourth extension member providing a fourth exterior end, each said exterior end having a hole there through, said fourth exterior end being folded over and positioned on top of said third exterior end, said second exterior end being folded over and positioned on top of said third exterior end, said first exterior end being folded over and positioned on top of said second exterior end, each said exterior end when positioned in the manner described allows each said hole to be aligned together, each said hole when aligned together in combination being of a shape and size to receive said fastener there through, said second extension member, said third extension member and said fourth extension member in combination form a three sided hollow spherical shape, and said first extension member forms said leg member.

11. The golf training aid kit of claim 1 wherein said three-dimensional hollow compression ball being formed only from interconnected loop and pile strips with a fastener in combination comprising: a piece of loop and pile material which when cut forms a first extension member; a second extension member; a third extension member and a fourth extension member; each said extension member being integrally interconnected at a central point, said first extension member being opposed to said second extension member, said third extension member being opposed to said fourth extension member, said second extension member, said third extension member, and said fourth extension member each having multiple air circulation holes there through, said first extension member providing an exterior end, said second extension member providing an exterior end, said third extension member providing an exterior end, said fourth extension member providing an exterior end, each said exterior end having a hole there through, each said exterior end being folded one on top of the other which allows each said hole to be aligned together, each said hole when aligned together in combination being of a shape and size to receive said fastener there through, said second extension member, said third extension member and said fourth extension member in combination form a three sided hollow spherical shape, and said first extension member forms said leg member.

12. The golf training aid kit of claim 1 further includes an accessory golf club head patch member which is formed from loop and pile fastener material having a first side and a second side, said loop and pile fastener material being cut so as to be of a shape and size to mate with a top side of said golf club head and said first side having a removably attached adhesive strip, whereby;

when said removably attached adhesive strip is removed, adhesive residue remains on said first side, and said first side of said loop and pile fastener material when positioned on said top side of said golf club head is held in a secure removably attached manner onto said top side of said golf club head by said adhesive residue.

13. The golf training aid kit of claim 1 further includes an accessory golf club head patch member which is formed from loop and pile fastener material having a first side and a second side, said loop and pile fastener material being cut so as to be of a shape and size to mate with a bottom side of said golf club head and said first side having a removably attached adhesive strip, whereby;

when said removably attached adhesive strip is removed, adhesive residue remains on said first side, and said first side of said loop and pile fastener material when positioned on said bottom side of said golf club head is held in a secure removably attached manner onto said bottom side of said golf club head by said adhesive residue.

14. The golf training aid kit of claim 1 wherein said golf club head patch member is in the form of an adjustable sock.

15. A method for a first player to play a novel game using a golf training aid kit which includes in combination a practice pad having a ball support structure thereon, a golf club head patch member which is removably attached onto a golf club head of a golf club, a three-dimensional hollow compression ball, and a score card, said golf club head patch member having indicia thereon for defining different sections thereof, and said different sections each representing a different numerical value that allows for calculating a winning score after play of said novel game, said method for playing said novel game comprising the steps of:

a. positioning said practice pad onto a support surface;

b. positioning said three-dimensional hollow compression ball onto said ball support structure;

c. aligning said golf club with said three-dimensional hollow compression ball in the usual manner;

d. initiating and completing a normal swing, whereby when said three-dimensional hollow compression ball is struck with said golf club head patch member, said three-dimensional hollow compression ball automatically adheres onto said golf club head patch member;

e. determining by visual inspection which said section said three-dimensional hollow compression ball has adhered onto;

f. determining a numerical value indicated by said indicia on said section that said three-dimensional hollow compression ball has adhered onto;

g. entering said numerical value onto said score card;

h. repeating steps "b" thru "g" again which completes one round;

i. repeating steps "b" thru "g" until nine rounds or eighteen swings have been completed;

and;

j. calculating an overall final score which is then entered onto said score card.

16. The method of claim 15 further includes at least a second player and said novel game further comprising the steps of:

a. repeating steps "b" thru "h" by said first player so as to finish a first round;

b. repeating steps "b" thru "h" by said second player so as to finish a first round;

c. repeating steps "b" thru "h" until each said player has completed nine rounds or eighteen swings;

d. calculating an overall final score for each said player which is then entered onto said score card;

and;

e. determining a winner by calculating which said player has the highest final score.

* * * * *